United States Patent [19]

Mechavich et al.

[11] 4,386,474

[45] Jun. 7, 1983

[54] SNOW HOE SHOE

[76] Inventors: Sylvester Mechavich, c/o George Spector, 3615 Woolworth Bldg., 233 Broadway, New York, N.Y. 10007; George Spector, c/o Sylvester Mechavich, 3615 Woolworth Bldg., 233 Broadway, New York, N.Y. 10007

[21] Appl. No.: 322,400

[22] Filed: Nov. 17, 1981

[51] Int. Cl.[3] ..... E01H 5/02

[52] U.S. Cl. ..... 37/285; 294/54

[58] Field of Search ..... 37/53, 270, 285; 294/54, 55–56; 15/104 R, 236 R; 172/764, 393

[56] References Cited

U.S. PATENT DOCUMENTS

| | | | |
|---|---|---|---|
| 3,091,790 | 6/1963 | Schroeder | 37/53 |
| 3,483,643 | 12/1969 | Wenzel | 37/53 |
| 3,773,375 | 11/1973 | Nehls | 294/54 |
| 3,998,486 | 12/1976 | Mittelstadt | 37/53 X |

FOREIGN PATENT DOCUMENTS

| | | | |
|---|---|---|---|
| 769375 | 10/1967 | Canada | 37/53 |
| 102095 | 7/1941 | Sweden | 37/53 |
| 654728 | 3/1979 | U.S.S.R. | 37/53 |

*Primary Examiner*—E. H. Eickholt

[57] ABSTRACT

An attachment for a hoe that is used to scrape snow off a house roof; the attachment consisting of a bent wire being passed under each end of the hoe blade scraping edge so to raise the edge off the surface of the roof shingles; each wire including either one or two passes under the scraping edge and both ends of the wire being held on a bolt secured in a hole made through the hoe blade.

2 Claims, 6 Drawing Figures

Fig. 1
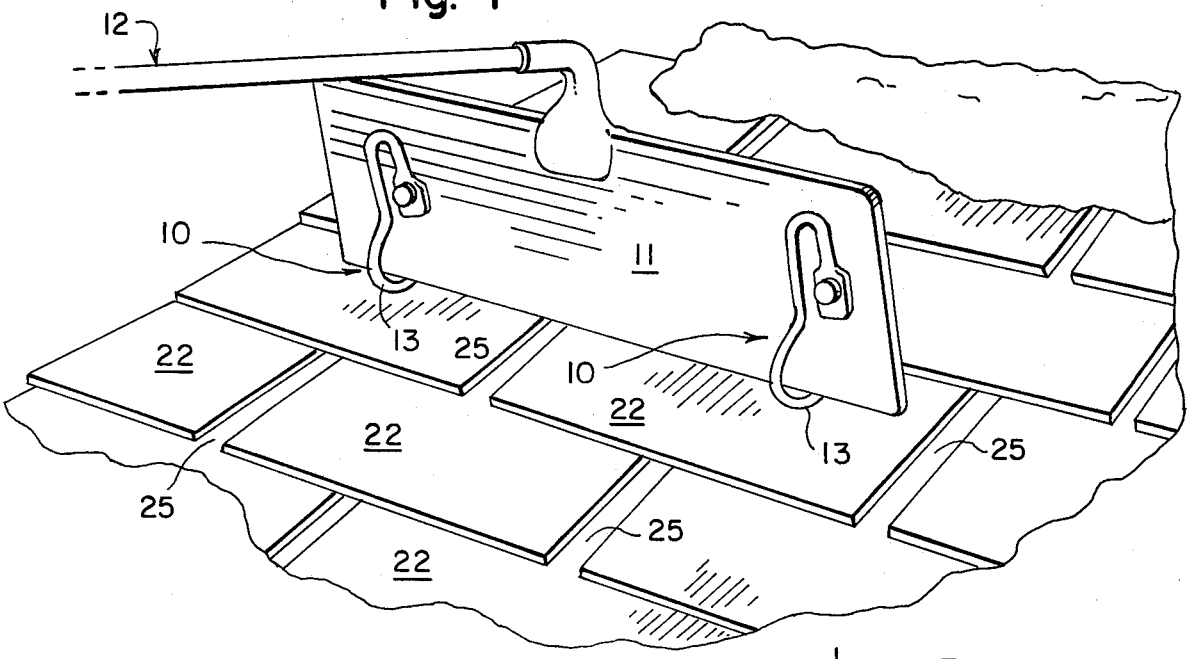
Fig. 2
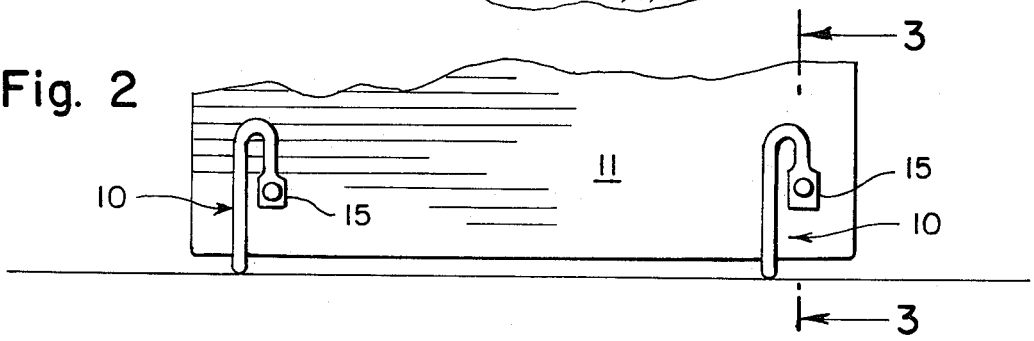
Fig. 3
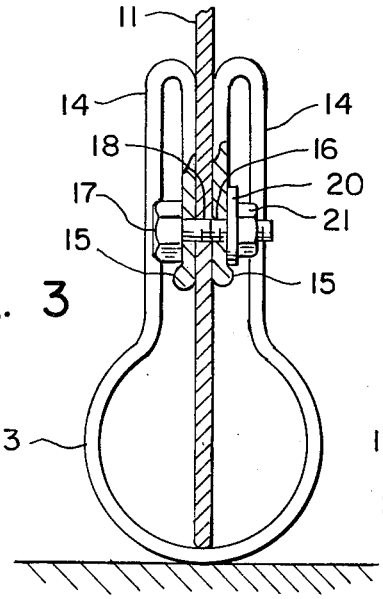
Fig. 4
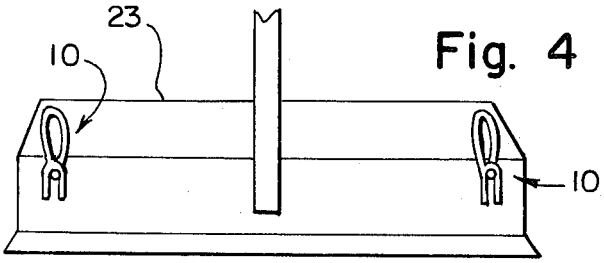
Fig. 5
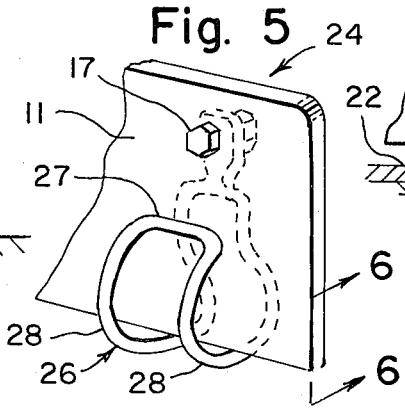
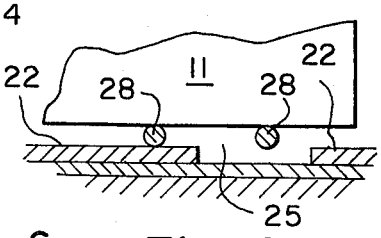
Fig. 6

SNOW HOE SHOE

This invention relates generally to attachments for a snow hoe such as is used for scraping snow off a house roof.

It is well known to those persons who have scraped snow off a house roof by using a snow hoe, that the scraping edge of the hoe blade is very damaging to the roof asphalt shingles by scraping against the shingles. Experience has shown that after a few years of using a snow hoe on a roof, the roof can develop leaks therethrough which results in expensive roof repairs. This objectionable situation is accordingly in need of an improvement.

Therefore it is a principal object of the present invention to provide an attachment for securement to each end of a snow hoe, and which keeps the hoe scraping edge spaced away from the surface of the roof shingles in order to not damage the same.

Another object is to provide a snow hoe shoe which can be readily and easily attached or removed from a snow hoe, whenever so wished.

In the drawing:

FIG. 1 is a perspective use of the invention installed on a snow hoe, and in use.

FIG. 2 is a fragmentary front view thereof.

FIG. 3 is an enlarged view in direction 3—3 of FIG. 2.

FIG. 4 is a perspective view of the invention installed on another design of the snow hoe.

FIG. 5 is a perspective view of another design of shoe installed on a snow hoe, and which includes a double pass thereof under the hoe scraping edge so to insure against scraping the shingles if traveling over a slit formed between the shingles.

FIG. 6 is an enlarged cross sectional view taken on line 6—6 of FIG. 5.

Referring now to the drawing in greater detail, and more particularly to FIGS. 1 through 3 thereof, at this time, the reference numeral 10 represents a shoe according to the present invention which isinstalled on each end of a blade 11 of a snow hoe 12. Each shoe ismade from a bent up length of cross sectionally round, ⅛ inch diameter, steel wire, which along its center is bentinto a circular loop 13 of approximately two inches diameter. Each opposite end of the wire is bent into a U-shaped, straight leg 14 which is flattened at the terminal end of the wire into a pad 15 having a hole 16 drilled therethrough, so to receive a bolt 17 that is also passed through a hole 18 drilled through the hoe blade. As bent shown in FIG. 3, the wire of the loop 13 abutts against the scraping edge 19 of the blade when installed on the hoe, with the blade extending fully down inside the loop, and each leg, together with its pad is on one side of the blade. A washer 20 and a nut 21 is fitted on the bolt for securement of the attachment to the hoe.

In use, it isnow evident that the single pass of the loop wire under the blade scraping edge keeps the edge spaced ⅛ inch away from the surface of the roof shingles 22 so to not scrape them.

In FIG. 4, the same design of shoe 10 is shown installed on a different model 23 of snow hoe, for a similar result.

Another design of snow hoe shoe 24, shown in FIGS. 5 and 6 is generally a same as show 10 except that it includes a space apart, double pass of the wire under the blade scraping edge, so to insure the scraping edge against contacting the shingle surface when the shoe travels on top a seam 25 formed between the shingles.

In this design, the central loop 26 along the wire is made U-shaped so that a U-shaped end 27 of the loop bears against one side of the hoe blade, and both legs 14 thus are on an opposite side of the blade. Thus the loop 26 includes two, parallel spaced apart, circular loop elements 28 formed by the single wire. Thus as shown in FIG. 6, if one loop element gets over a shingle seam 25, the scraping edge does not drop down against the shingle surface, because the other loop element 28 resting on the shingle surface, holds the blade up. It is understood that the elements 28 are spaced apart more than a width of the seam 25.

What is claimed as new, is:

1. A snow hoe shoe assembly, comprising in combination a snow hoe and a pair of spaced apart shoes mounted on said snow hoe, said hoe comprising a flat blade on one end of a handle, a straight scraping edge on said blade, and a hole near each opposite end of said blade extending therethrough for support of said shoe, each said shoe comprising a bent up steel wire, a circular loop along a center of said wire and a straight leg at each end of said wire each said leg being laterally spaced from said loop, a bolt through said blade hole and through said shoe legs, said central loop passing under said scraping edge.

2. The combination as set forth in claim 1, wherein said loops are U shaped to provide a pair of spaced apart shoe elements for bridging over spaced roof shingle seams.

* * * * *